United States Patent [19]

Hanson

[11] Patent Number: 4,903,498

[45] Date of Patent: Feb. 27, 1990

[54] TEMPERATURE CONTROLLING FOR A TRANSPORT REFRIGERATION SYSTEM

[75] Inventor: Jay L. Hanson, Bloomington, Minn.

[73] Assignee: Thermo King Corporation, Minneapolis, Minn.

[21] Appl. No.: 236,878

[22] Filed: Aug. 26, 1988

[51] Int. Cl.[4] ..... F25B 49/00

[52] U.S. Cl. ..... 62/126; 62/160; 62/229

[58] Field of Search ..... 62/160, 125, 126, 127, 62/129, 159, 160, 228.1, 228.4, 228.5, 196.2, 229, 323.1; 165/26

[56] References Cited

U.S. PATENT DOCUMENTS

| | | | |
|---|---|---|---|
| 4,143,707 | 3/1979 | Lewis et al. | 62/160 X |
| 4,161,880 | 7/1979 | Prosky . | |
| 4,234,927 | 11/1980 | First . | |
| 4,257,238 | 3/1981 | Kountz et al. . | |
| 4,288,853 | 9/1981 | Uesugi . | |
| 4,292,813 | 10/1981 | Paddock . | |
| 4,313,308 | 2/1982 | Boratgis et al. . | |
| 4,325,224 | 4/1982 | Howland . | |
| 4,358,936 | 11/1982 | Ito et al. . | |
| 4,380,155 | 4/1983 | Paddock . | |
| 4,403,296 | 9/1983 | Prosky . | |
| 4,419,866 | 12/1983 | Howland . | |
| 4,432,210 | 2/1984 | Saito | 62/126 |
| 4,443,117 | 4/1984 | Mursmoto et al. . | |
| 4,455,095 | 6/1984 | Bleiker . | |
| 4,463,436 | 7/1984 | Veneklase . | |
| 4,493,191 | 1/1985 | Hanson . | |
| 4,504,010 | 3/1985 | Sukimoto et al. . | |
| 4,504,922 | 3/1985 | Johnson et al. . | |

FOREIGN PATENT DOCUMENTS 2174510 11/1986 United Kingdom .

*Primary Examiner*—Harry B. Tanner
*Attorney, Agent, or Firm*—D. R. Lackey

[57] ABSTRACT

A ratiometric temperature controller for a transport refrigeration system, and a method of controlling the load temperature of a transport refrigeration system with digital signals provided in response to an analog ratio between the load temperature and a selected set point temperature. A logic array is programmed to provide a plurality of transport refrigeration system control signals in response to predetermined values of the digital signal. The resolution of the control is increased by having the digital signal respond to a temperature range relatively close to set point, which is a much smaller range than the temperature range over which the set point may be selected. The logic array will respond to a forcing signal which, when true, indicates the need for a high speed cooling mode, when the load temperature is above set point and the system is already in a cooling mode.

4 Claims, 4 Drawing Sheets

A/D
PAL
TIMER
DIGITAL OUTPUTS
FORCE HIGH SPEED COOL (FHSC)
1 = OK
0 = SHORT
0 = OK
1 = OPEN
RTD
(AR)
+5V
VCC
LSB
MSB
FHSC
SS
SO
PU
HT
HL
HLH
HLo
IR
LS
(IR)
(LS)
(HS)
(HT)
(HLo)
R1
R2
R3
R4
R5
R6
R7
R8
R9
R10
R11
R12
R13
C1
C2
C3
C4
C5
C6
20
32
34
36
38
40
42
44
50
52
54
56
58
60
62

| MODE-TEMP. FALLING ↓ | DIGITAL SIGNAL (MSB … LSB) A | B | C | D | E | F | G | H | WORD # | TEMP. RE SET POINT | |
|---|---|---|---|---|---|---|---|---|---|---|---|
| H.S. COOL NOT - IN RANGE | 0 | 0 | 0 | 0 | 0 | 0 | 0 | 0 | 1 | +27 | H.S. COOL NOT - IN RANGE |
| | 0 | 1 | 0 | 1 | 1 | 1 | 1 | 1 | 95 | +6.7 | |
| | 0 | 1 | 1 | 0 | 0 | 0 | 0 | 0 | 96 | | H.S. COOL IN RANGE |
| | 0 | 1 | 1 | 0 | 0 | 1 | 1 | 1 | 103 | +5.0 | |
| | 0 | 1 | 1 | 0 | 1 | 0 | 0 | 0 | 104 | | L.S. COOL IN RANGE |
| | 0 | 1 | 1 | 0 | 1 | 1 | 1 | 1 | 111 | +3.4 | |
| L.S. COOL IN RANGE | 0 | 1 | 1 | 1 | 0 | 0 | 0 | 0 | 112 | | |
| | 0 | 1 | 1 | 1 | 0 | 1 | 1 | 1 | 119 | +1.7 | |
| | 0 | 1 | 1 | 1 | 1 | 0 | 0 | 0 | 120 | | L.S. HEAT IN RANGE |
| | 0 | 1 | 1 | 1 | 1 | 1 | 1 | 1 | 127 | SET POINT | |
| L.S. HEAT IN RANGE | 1 | 0 | 0 | 0 | 0 | 0 | 0 | 0 | 128 | | |
| | 1 | 0 | 0 | 0 | 0 | 1 | 1 | 1 | 135 | -1.5 | |
| | 1 | 0 | 0 | 0 | 1 | 0 | 0 | 0 | 136 | | H.S. HEAT NOT - IN RANGE |
| | 1 | 0 | 0 | 0 | 1 | 1 | 1 | 1 | 143 | -3.2 | |
| H.S. HEAT IN RANGE | 1 | 0 | 0 | 1 | 0 | 0 | 0 | 0 | 144 | | |
| | 1 | 0 | 0 | 1 | 1 | 1 | 1 | 1 | 159 | -6.5 | |
| H.S. HEAT NOT - IN RANGE | 1 | 0 | 1 | 0 | 0 | 0 | 0 | 0 | 160 | | |
| | 1 | 1 | 1 | 1 | 1 | 1 | 1 | 1 | 256 | -27 | ↑ MODE-TEMP. RISING |

FIG. 4

TEMPERATURE CONTROLLING FOR A TRANSPORT REFRIGERATION SYSTEM

BACKGROUND OF THE INVENTION

1. Field of the Invention

The invention relates in general to transport refrigeration systems, and more specifically to new and improved temperature controllers, and methods of controlling the load temperature of such refrigeration systems.

2. Description of the Prior Art

Transport refrigeration systems for trailers and trucks have many different operating control arrangements for improving load temperature control while reducing fuel costs of the internal combustion engine, such as a Diesel engine, which commonly drives the refrigeration compressor. For example, it is common to employ a plurality of different heating and cooling modes, depending upon where the load temperature is relative to the set point temperature. In a cooling mode, in which the load requires cooling to maintain the set point, the hot gas output from the compressor is directed through a first fluid circuit which includes a condenser, expansion valve, and evaporator. In a heating mode, in which the load requires heating to maintain the set point, or in which the evaporator requires defrosting, the hot gas is directed through a second fluid circuit which by-passes the condenser and goes directly to an evaporator defrost pan heater and then through the evaporator.

To provide different heating and cooling capacities, it is common to operate the compressor at one of two different speeds, called high speed and low speed. Still additional capacity control may be provided by operating the compressor partially unloaded during the low speed heating and cooling modes.

In an effort to conserve fuel, when a shift from low speed to high speed is called for by the load temperature control, it is known to delay the change from low to high speed to insure that the requirement is not transitory. If the system is still calling for high speed heating or cooling after the time delay, then the shift to high speed is made. U.S. Pat. No. 4,325,224, which is assigned to the same assignee as the present application, sets forth examples of different heating and cooling modes, including partial heating and cooling modes via compressor unloading, and the use of time delays between low and high speed modes.

In a further effort to conserve fuel, instead of operating the compressor continuously, there are times when the compressor and its driving engine may be turned off for significant periods of time without deleteriously affecting load temperature. U.S. Pat. No. 4,419,866, which is assigned to the same assignee as the present application, discloses the alternative use of either continuous or start-stop compressor operating modes.

My co-pending application Ser. No. 020,259 filed Feb. 27, 1987, entitled "Temperature Controller For A Transport Refrigeration System", now U.S. Pat. No. 4,819,441 which is assigned to the same assignee as the present application, discloses a new temperature controller for transport refrigeration systems in which an analog ratio between the load temperature and the set point temperature is developed. The analog ratio is converted to a digital signal in a digital to analog converter, including scaling the converter inputs such that the set point is at the midpoint of the possible number of bit changes from all logic zeros to all logic ones. Further, the scaling and the number of bits in the digital signal are selected such that all logic zeros and all logic ones represent implausible temperature deviations from the set point. Thus, a digital signal in which all the bits are logic zero or logic one may conveniently be used to provide a sensor failure signal. Low cost programmable logic arrays (PAL'S) are programmed to utilize different values of the digital signal to provide a plurality of different control signals which may initiate any desired number of different heating and cooling modes, as well as recognize events which may be used to start external timers. The timers then provide signals for the PAL which initiate, maintain, or terminate, predetermined heating and cooling modes, as desired.

While the temperature controller of my co-pending application performs well, it would be desirable, and it is the object of the present invention, to provide a new and improved temperature controller for transport refrigeration systems, which retains the digital, programmable aspects of the controller in my co-pending application while reducing the complexity and cost of the controller. It would further be desirable to increase the resolution of the controller.

SUMMARY OF THE INVENTION

Briefly, the present invention is a new and improved temperature controller for transport refrigeration systems, and new and improved methods for controlling a transport refrigeration system which include the step of providing digital output signals which enable all but the most essential functions to be eliminated from the controller itself, and added as options, as required or desired, performable by specialized external control devices which utilize the output signals provided by the controller. The present invention spreads the whole digital range of a digital signal developed in response to an analog ratio between the load temperature and the selected set point temperature, to a relatively small temperature range about set point, greatly increasing the resolution of the controller. Sensor opens and shorts are detected by comparisons made from the analog ratio, rather than by detecting values of the digital signal, as the digital signal will have no values outside the small temperature range about set point, which range is much smaller than the range over which the set point temperature may be set.

The temperature controller of the present invention also enables a high speed cool mode of the transport refrigeration system to be forced when a predetermined input signal to the controller goes true, if the load temperature is above set point, and the system is already in the cooling mode. The temperature controller will then maintain the system in high speed cool until the load temperature is forced to set point. This is desirable in certain instances, as disclosed in concurrently filed application Ser. No. 07/236,875, Filed Aug. 06, 1988 entitled "Rate Of Change Temperature Control For Transport Refrigeration Systems", which is assigned to the same assignee as the present application.

BRIEF DESCRIPTION OF THE DRAWINGS

The invention may be better understood and further advantages and uses thereof more readily apparent when considered in view of the following detailed description of exemplary embodiments, taken with the accompanying drawings, in which:

FIG. 4 is diagram which sets forth an exemplary digital algorithm which may be used in programming the programmable logic array shown in FIG. 2, to implement other aspects of the invention.

DESCRIPTION OF PREFERRED EMBODIMENTS

In order to reduce the length and complexity of the present application, the hereinbefore mentioned U.S. Pat. Nos. 4,325,224, 4,419,866, and 4,819,441 and the heretobefore mentioned co-pending application Ser. No. 07/236,875 are hereby incorporated into the present specification by reference.

Figure 1:
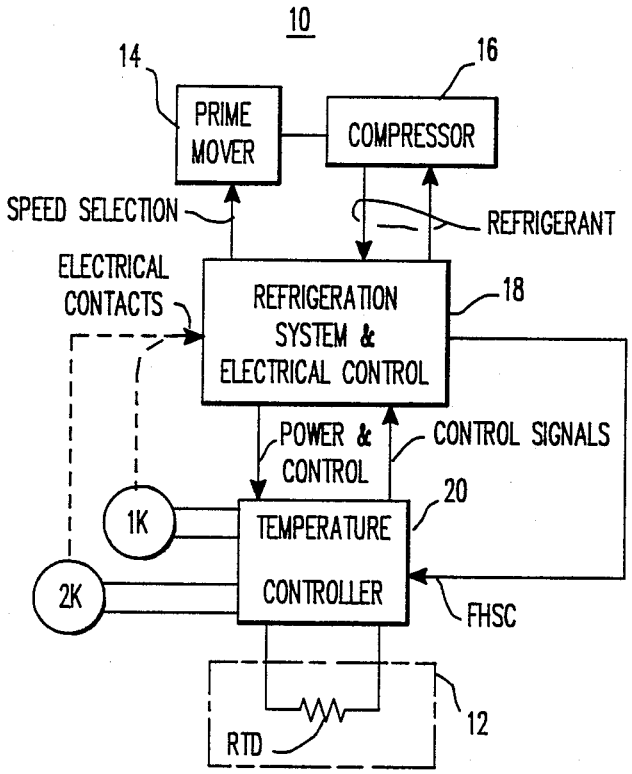
FIG. 1 is a block diagram of a transport refrigeration system having a temperature controller which may be a programmable ratiometric temperature controller constructed according to the teachings of the invention.

Referring now to the drawings, and to FIG. 1 in particular, there is shown a transport refrigeration system 10 for conditioning the air in a served space 12 of a truck, trailer, refrigerated container, and the like. Refrigeration system 10 includes a prime mover 14, such as a Diesel engine, which is operable in continuous or start-stop modes, at a selected one of high and low speeds, such as 2200 RPM and 1400 RPM, as disclosed in the incorporated patents. The prime mover 14 drives a refrigerant compressor 16 for a refrigeration unit 18 which includes refrigeration components and electrical control. A temperature controller 20 responds to a sensor RTD disposed in the served space 12, and to electrical power and control signals from unit 18, to provide control signals for the operation of unit 18 as well as for operating heat and speed relays 1K and 2K, respectively. Heat relay 1K, when de-energized, has electrical contacts in unit 18 which select a cooling mode, and when energized it has contacts which select a heating mode. Speed relay 2K, when energized, has contacts in unit 18 which select the high speed mode for prime mover 14, and the low speed mode when de-energized.

Figure 2:
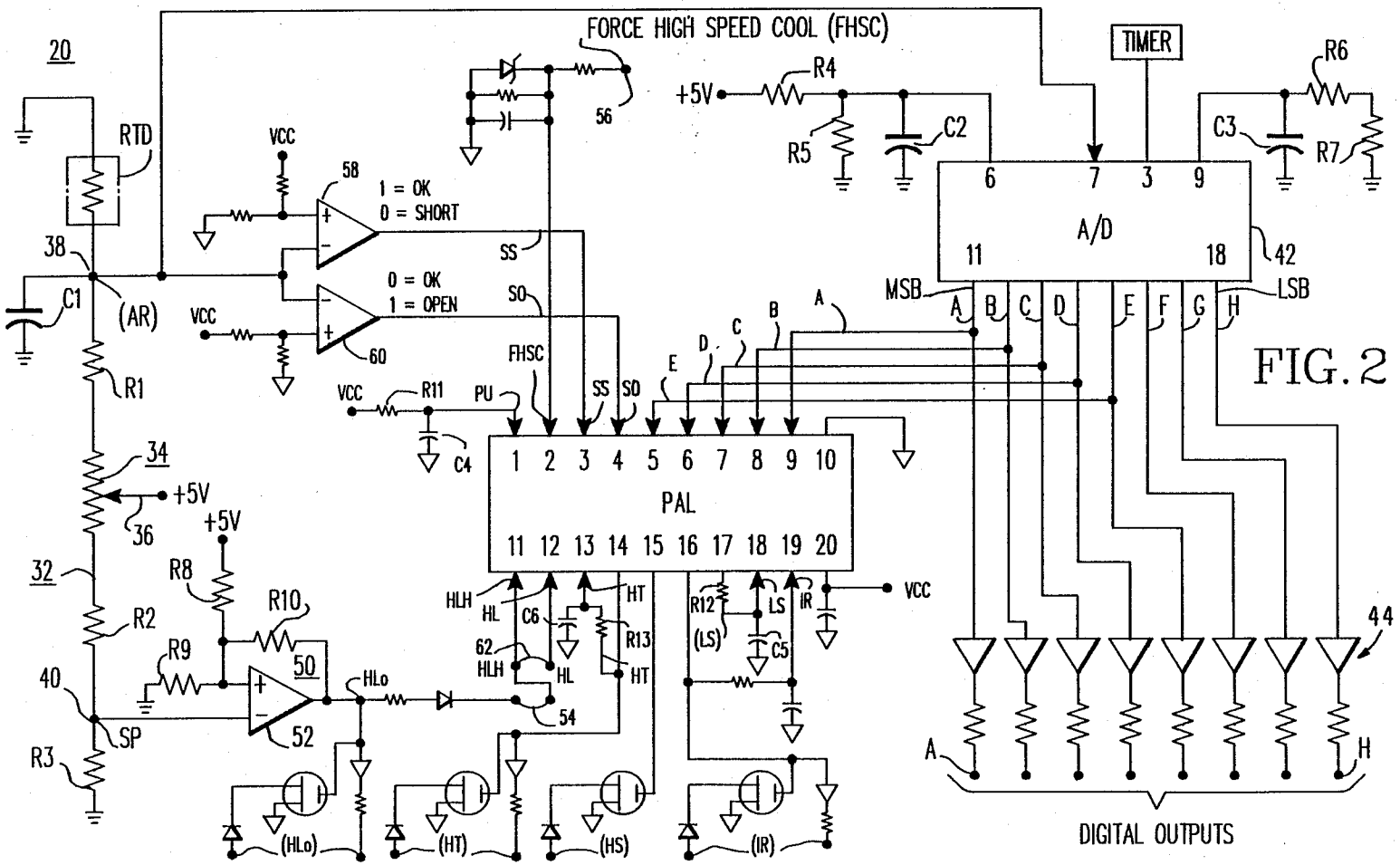
FIG. 2 is detailed schematic diagram of a temperature controller which may be used for the controller shown in block form in FIG. 1, setting forth certain teachings of the invention.

Referring now to FIG. 2, which is a detailed schematic diagram of temperature controller 20 constructed according to the teachings of the invention, a voltage divider 32 provides a voltage SP responsive to a selected temperature point and an analog ratio AR. Voltage divider 32 includes the sensor or resistance temperature device RTD for sensing the temperature of a load in the served space 12 whose temperature is to be controlled, and a capacitor C1 for lead compensation. The RTD, for example, may be sensor #2908B07 available from the assignee of the present application, which has a temperature range well within the control range requirements (+80 to −20 degrees F.) of transport refrigeration system 10 and a resistance change per degree of temperature change compatible with the associated circuitry. For example, in the preferred embodiment it may have a resistance change of 4.86 ohms per degree F., and a resistance of 3266 ohms at 32 degrees F.

Voltage divider 32 further includes a set point potentiometer (pot) 34 having a control arm 36 to which a regulated control voltage VCC is applied, such as +5 volts DC. Resistors R1, R2 and R3 complete the elements of the voltage divider 32, with the various elements being serially connected from ground to ground in the following order: RTD, R1, pot 34, R2 and R3. The junction 38 between RTD and R1 provides the analog ratio AR between the load temperature and the temperature selected by pot 34; and the junction 40 between R2 and R3 provides the voltage SP responsive to set point.

When the resistance of RTD equals the resistance of R1 plus the setting of pot 34, the temperature of the controlled load is at the set point temperature, and the voltage AR at junction 38 will be equal to 50% of VCC or 2.5 volts.

The analog ratio AR is applied to an analog to digital converter (A/D) 42, preferably of the type having differential analog voltage inputs, such as National Semiconductor's ADC0804. The inputs to A/D 42 are used as a ratiometric comparator which compares the voltage at input pin #7, which is a variable percentage of VCC, with fixed percentages of VCC at input pins #6 and #9. Resistors R4 and R5 form a voltage divider which applies a voltage equal to 52% of VCC to pin #6, and resistors R6 and R7 set the reference voltage at pin 9 to 2% of VCC. Capacitors C2 and C3 are filter capacitors. A/D 42 functions by subtracting the voltage at pin #7 from the voltage at pin #6, and the difference is compared with the reference voltage at pin #9. Thus, for example, when the analog ratio AR at pin #7 is equal to 50% of VCC, indicating the load temperature is equal to the set point temperature, the difference between pins #7 and #6 will be equal to 2% VCC, and thus the difference is equal to the reference voltage of pin #9.

Pins #11 through #18 provide an eight bit digital signal A through H, respectively, with pin #11 and bit A being the most significant bit (MSB) and with pin #18 and bit H being the least significant bit (LSB). The digital signal A–H is buffered by buffers 44, as shown in FIG. 2, and is available as an external digital output at output terminals A–H. With eight bits, there are 256 output bit combinations, with A/D 42 being 50% through the conversion when the voltage at pin #7 is 50% of VCC. Thus, when the load temperature is equal to the set point, the digital signal will be at digital word 128 or 1000 0000. The limits of the conversion are such that when the voltage at pin #7 is 52% of VCC, the conversion is complete, with the digital signal being at word 256 or 1111 1111, and when the voltage at pin #7 is 48% of VCC the digital signal is at the first word or 0000 0000.

The inputs of A/D 42 are scaled such that a 0.21 degree F. change in load temperature toggles or produces a one bit change in the digital output signal A–H when the load temperature is within ±27 degrees of the selected set point temperature. This relatively small range relative to the set point provides an increased resolution, as there are 256 digital words within this range. This ±27 degree temperature range is small compared with the controlled range of +80 degrees F. to −20 degrees F., within which the temperature set point may be set.

Pot 34 and resistors R2 and R3 form a voltage divider which provides a voltage SP at junction 40 which is proportional to the temperature set point. The set point voltage SP is used by a heat lock-out function 50 which is activated when the set point temperature selected by pot 34 is below a predetermined temperature, eg., 15 degrees F. If this function is desired, heating modes for controlling the load temperature will be locked out or prevented when the selected set point is below the heat lock-out temperature of 15 degrees F. Heat lock-out function 50 includes an operational amplifier (op amp) 52, resistors R8, R9, and R10 and VCC. Resistors R8 and R9 and VCC provide a voltage divider which applies a voltage to the non-inverting input of op amp 52 which is equal to the voltage SP when pot 34 is set to a set point temperature of 15 degrees F. Resistor R10 is a feedback resistor used for hysteresis to prevent switch-over hunt when SP is at or near the 15 degree F. switch point.

In the operation of the heat lock-out function 50, when the set point selected on pot 34 is above the 15 degree F. switch point selected for purposes of example, the output HLO of op amp 52 will be a logic zero. When the set point is below 15 degrees F., the output HLO of op amp 52 switches to a logic one. The heat lock-out feature may be deactivated by opening jumper 54.

An input terminal 56 receives a signal FHSC, which is true or a logic one when external control 18 desires that the transport refrigeration system be forced into a high speed cooling mode. The incorporated application Ser. No. 07/236,875 may be referred to for control for providing such a signal.

The digital signal A–H, the heat lock-out signal HLO and the force-to-high-speed-cool signal FHSC are decoded according to digital algorithms in a programmable logic array PAL. For example, logic array PAL may be array PAL14H4 which has 14 inputs and 4 outputs.

Since all values of the 8-bit digital signal A–H represent temperatures within the controlled temperature range, it is not possible to detect failure of sensor RTD from digital signal values per se. According to the teachings of the invention, sensor shorts and open conditions are detected by operational amplifiers 58 and 60, respectively, which are connected as comparators. The analog ratio AR is connected to the inverting inputs of op apms 58 and 60, and appropriate reference voltages are connected to the non-inverting inputs. If the ratio AR is implausibly large, the output SS of op amp 58 will switch from a logic one, which value indicates the sensor is not shorted, to a logic zero, which indicates that it is shorted. If the ratio AR is implausibly small, the output SO of op amp 60 will switch from a logic zero, which value indicates the sensor RTD is not open, to a logic one, which indicates that it is open. Output signals SS and SO are connected to inputs of PAL.

VCC provides an input PU to an input of PAL, which comes up to a logic one after power is initially applied according to the time constant of resistor R11 and capacitor C4.

Figure 3:
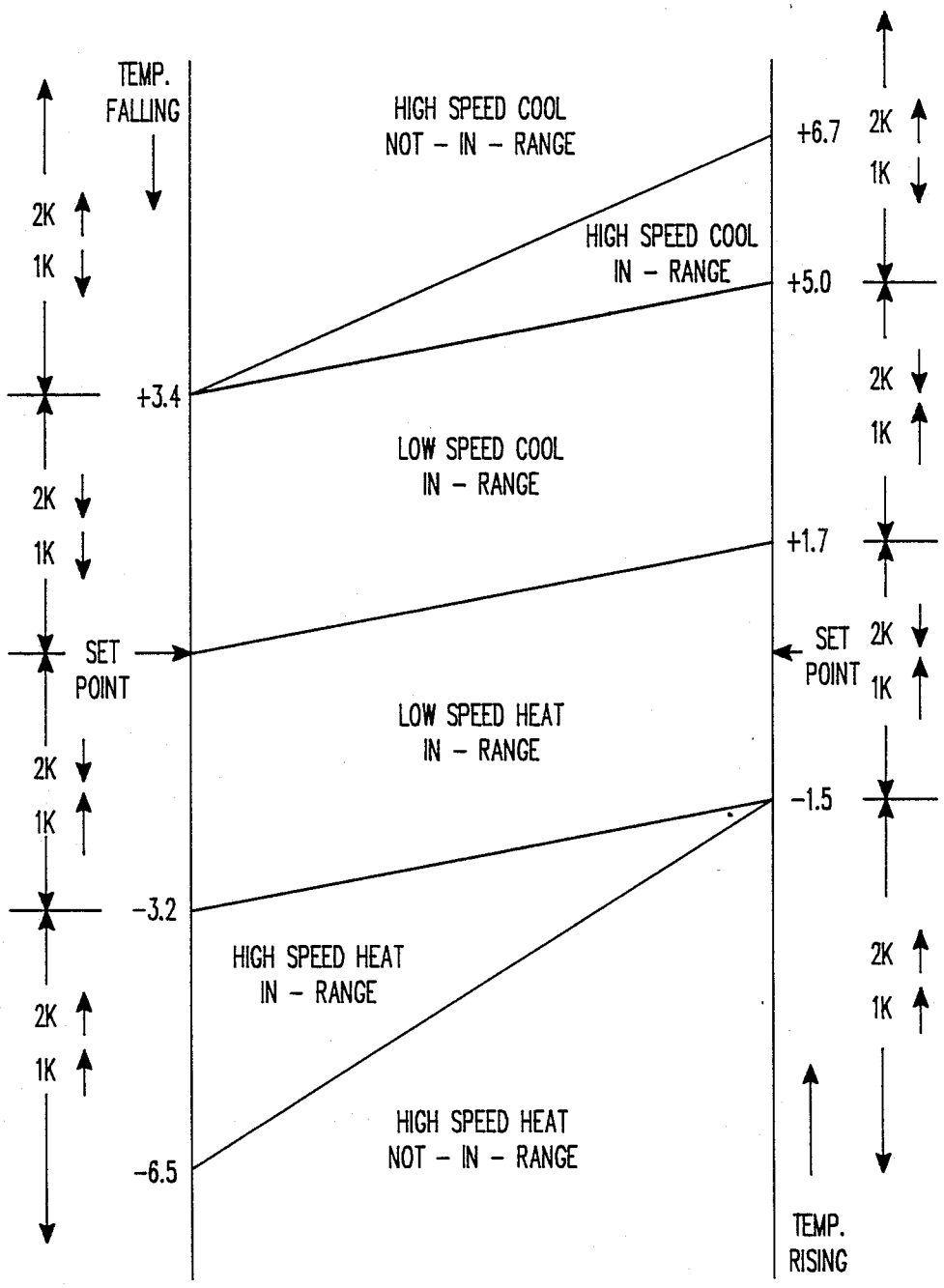
FIG. 3 is a diagram which sets forth basic cooling and heating modes performable by the temperature controller of the invention, and which may be tailored to provide a variety of other modes in response to digital output signals provided by the temperature controller.

FIG. 3 illustrates the high and low speed heating and cooling modes which controller 20 will provide. A falling load temperature is indicated by starting at the top of the diagram and proceeding downwardly along the left-hand side. A rising load temperature is indicated by starting at the bottom of the diagram and proceeding upwardly along the right-hand side. The energized and de-energized conditions of the speed and heat relays 2K and 1K, respectively, are indicated for each of the different heating and cooling modes, with an upwardly pointed arrow indicating the associated relay is energized, and a downwardly pointing arrow indicating that it is de-energized.

FIG. 4 sets forth a digital algorithm which shows the values of the digital signal which will trigger the different high and low speed heating and cooling modes.

As shown in FIG. 2, logic array PAL has four outputs IR (in-range), LS (low speed), HS (high speed) and HT (heat). Outputs IR, LS and HT are fed back to three of the fourteen inputs of PAL. Additional inputs are provided by the five most significant bits A, B, C, D and E of the digital signal A–H, and the heat lock-out signal HLO. When jumper 54 is in place it provides a heat lock-out signal HLH for one of the inputs of PAL, and when a second jumper 62 is in place it provides a heat lock-out signal HL for another input of PAL.

Jumpers 54 and 62 determine the heat lock-out mode. If jumpers 54 and 62 are both in place, there is total heat lock out, both low and high speed, when the set point is below the heat lock out switch point. If only jumper 62 is removed, only high speed heat will be locked out. Removal of jumper 54 eliminates all heat lock-out.

Programming of the logic arrays will now be described for providing signals which will go true at the appropriate times to implement the diagrams shown in FIGS. 3 and 4.

In-range IR

The in-range signal IR at pin #16 of PAL is true, as indicated in FIG. 4, for a falling temperature during digital words 112 through 159, and for a rising temperature during digital words 135 through 96. To decode this range requires the following Boolean expression:

```
IR=LS*PU+/A*B*C*D*PU+A*/B*/C*IR*-
  PU+A*HL*/SO*SS*PU
```

Low Speed LS

Low speed output LS from pin #17 of PAL is true, as indicated on the digital algorithm in FIG. 4, during words 112 through 143 for a falling temperature, and during words 135 through 104 for a rising temperature. Resistor R12 and capacitor C5 are used for hysteresis during transitions between certain of the words. The RC time constant provided by R12 and C5 will hold the low speed output LS high until the analog to digital transition is complete. The Boolean expression for low speed is as follows:

```
LS=/A*B*C*D+/A*B*C*D*E*L-
  S+A*/B*/C*/D*/E+A*/B*/C*/D*E*LS
```

Heat HT

Heat output HT from pin #14 of PAL is true during set point and below, and words 127 through 120 above set point for a rising temperature, with a one bit hysteresis feedback to input pin #13 via resistor R13 and capacitor C6. The Boolean expression for a true signal HT is as follows:

```
HT=A*/SO*SS*/HL*PU+/A*B*C*D*E*/-
  SO*SS*/HL*HT*PU
```

High Speed Output HS

The high speed output from pin #15 of PAL goes high when a high speed mode is called for according to FIGS. 3 and 4. The Boolean expression for the high speed output HS is as follows:

HS=/A*/SO*SS*/LS*PU+A*-
/OS*SS*/HLH*/HL*/LS*PU+FSHC*/HT*-
/SO*SS*/A*PU

It will be noted that a true signal FSHC will not automatically force high speed. A true signal FSHC, when received, is related to the programmed logic of PAL, forcing the high speed cooling mode if: (1) the system is in a cooling mode (/HT is high); and (2) the temperature is above set point (/A is high). It will also be noted that output HS will then remain true, ie., the system will remain in the high speed cooling mode once it has been forced, until the MSB "A" goes high to signify that the selected set point temperature has been reached.

I claim as my invention:

1. A method of controlling the load temperature of a transport refrigeration system having heating and cooling modes, and high and low speed modes, comprising the steps of:

selecting a set point temperature within a first predetermined temperature range, sensing the load temperature, providing an analog ratio between the set point temperature and the load temperature, comparing the analog ratio with first and second predetermined reference values to detect when the load temperature sensed by the sensing step has implausible values, converting the analog ratio to a digital signal having a predetermined number of bits which provides a predetermined number of bit changes between all logic zeros and all logic ones, said converting step including the step of scaling the conversion such that all of the predetermined number of bit changes occur within a second predetermined temperature range relative to set point, with the second predetermined temperature range being smaller than the first temperature range, and providing a logic array programmed to provide a plurality of output signals for controlling the transport refrigeration system in response to predetermined values of the digital signal.

2. The method of claim 1 including the steps of:

buffering the digital signal, and providing output terminals connected to the buffered digital signal.

3. A load temperature controller for a transport refrigeration system having heating and cooling modes, and high and low speed modes, comprising:

selector means for selecting a set point temperature within a first predetermined temperature range, sensor means for sensing the load temperature, means for providing an analog ratio between the selected set point temperature and the sensed load temperature, means providing first and second analog reference signals, comparator means for comparing said first and second analog reference signals with the analog ratio to detect failure of the sensor means, converter means for converting the analog ratio to a digital signal having a predetermined number of bit changes between all logic ones and all logic zeros, said converter means scaling the conversion such that all of the predetermined number of bit changes occur within a second predetermined temperature range relative to set point, with the second predetermined temperature range being smaller than the first temperature range, and logic array means having inputs responsive to said digital signal, said logic array means being programmed to provide a plurality of transport refrigeration system control signals in response to predetermined values of the digital signal.

4. The load temperature controller of claim 3 including:

means buffering the digital signal, and output terminal means for making the buffered output digital signal available as an output signal.

* * * * *